US006490492B1

(12) United States Patent
Fertig et al.

(10) Patent No.: US 6,490,492 B1
(45) Date of Patent: Dec. 3, 2002

(54) DEVICE FOR DETERMINING METHOD DATA OF A METHOD FOR COSMETICALLY TREATING HAIR ON A PERSON'S HEAD

(75) Inventors: Werner Fertig, Bensheim (DE); Dieter Hoch, Pfungstadt-Eich (DE); Detlef Mattinger, Bickenbach (DE)

(73) Assignee: Wella Aktiengesellschaft, Darmstadt (DE)

( * ) Notice: Subject to any disclaimer, the term of this patent is extended or adjusted under 35 U.S.C. 154(b) by 0 days.

(21) Appl. No.: 09/554,133

(22) PCT Filed: Sep. 13, 1999

(86) PCT No.: PCT/EP99/06772

§ 371 (c)(1),
(2), (4) Date: May 9, 2000

(87) PCT Pub. No.: WO00/15073

PCT Pub. Date: Mar. 23, 2000

(30) Foreign Application Priority Data

Sep. 11, 1998 (DE) ..... 198 41 633

(51) Int. Cl.[7] ..... G06F 17/00

(52) U.S. Cl. ..... 700/90; 345/700; 345/705; 132/212

(58) Field of Search ..... 700/90; 345/700, 345/705, 856; 132/212

(56) References Cited

U.S. PATENT DOCUMENTS 4,519,037 A * 5/1985 Brodeur et al. ..... 700/90
4,569,421 A 2/1986 Sandstedt ..... 186/39

FOREIGN PATENT DOCUMENTS

| | | |
|---|---|---|
| EP | 0 320 749 A | 6/1989 |
| EP | 0 824 879 A | 2/1998 |
| FR | 2 429 462 A | 1/1980 |
| GB | 2 251 960 A | 7/1992 |
| WO | 96 41139 A | 12/1996 |

* cited by examiner

*Primary Examiner*—Thomas Black
*Assistant Examiner*—Ronald D Hartman, Jr.
(74) *Attorney, Agent, or Firm*—Michael J. Striker

(57) ABSTRACT

Device (1) for determining process data for a cosmetic treatment process for treating hair on the head of a person, with a microprocessor (3), at least one storage (4) containing at least one application program (5), a data input device (6), a data evaluation device (7), at least one process data output device (8), and a display device (9), wherein the device (1) is provided as a battery-operated hand-held device (2), the storage or storages (4) being contained in at least one optionally exchangeable module (10, 10.1); the application program (5) contains at least one data table (11) and application texts (12) which communicate with the data input device (6), the data evaluation device (7), the process data output device (8) and the display device (9), a dialog menu management being provided via the display device (9) as a data input device (6) through use of a menu program (13), and in that data is entered through use of a cursor function.

24 Claims, 15 Drawing Sheets

FIG.9

ANALYSIS - RESULTS 111

| | | |
|---|---|---|
| root coloring | | |
| length/ends | : | 12/0 |
| natural hair color | : | 6/0 |
| white content | : | low |
| hair thickness | : | thick |
| hair length | : | medium |
| desired color | : | 12/00 |

FIG.10

ANALYSIS - RESULTS 111.1 full coloring

| | | |
|---|---|---|
| natural hair color | : | 6/43 |
| white content | : | high |
| hair thickness | : | thick |
| hair length | : | medium |
| desired color | : | 12/00 |

FIG.11

STANDARD COLORING 112

| | | |
|---|---|---|
| tint | : | 12/03 |
| peroxide | : | 12% |
| mixture | : | 1+2 |
| amount color cream | : | 120gr |
| action time, total | : | 60min |

FIG.12

STANDARD COLORING 112.1 pre-bleaching

| | | |
|---|---|---|
| tint | : | 12/03 |
| peroxide | : | 12% |
| mixture | : | 1+2 |
| amount color cream | : | 120gr |
| action time, total | : | 60min |

FIG.13

STANDARD COLORING 112.2 tint: 12/03 + 12/11

| | | |
|---|---|---|
| peroxide | : | 12% |
| mixture | : | 1+2 |
| amount color cream | : | 120gr |
| action time, total | : | 60min |

FIG.14

STANDARD COLORING 112.3 pre-bleaching tint: 12/03 + 12/11

| | | |
|---|---|---|
| peroxide | : | 12% |
| mixture | : | 1+2 |
| amount color cream | : | 120gr |
| action time, total | : | 60min |

FIG.15

STANDARD COLORING 112.4 tint : 12/03 + 12/11 + 0/33
peroxide : 12%
mixture : 1+2
amount color cream : 120gr
action time, total : 60min

FIG.16

STANDARD COLORING 112.5 tint : 12/03 + 12/11 + 0/33
peroxide : 12%
mixture : 1+2
amount color cream : 120gr
action time, total : 60min

FIG.17

Full pre-bleaching to the desired lightness

113 bleach peroxide 6%

FIG.18

Pre-bleaching of roots to the desired lightness 113.1 bleach peroxide 6%

FIG.19

Bleaching wash 113.2

1 part bleach
1 part peroxide 6%
1 part water

FIG.20

Bleaching wash 113.3
length and ends 1 part bleach
1 part peroxide 6%
1 part water

FIG.21

Bleaching wash 113.4
root 1 part bleach
1 part peroxide 6%
1 part water

FIG.22

STANDARD COLORING 114

Take color cream

6/55 = 40g

Mixture: 1+1 with peroxide 12% = 40g
Total amount color cream 80g

FIG.23

STANDARD COLORING 114.1

Take color cream

6/55 = 30g
6/0 = 30g

Mixture: 1+1 with peroxide 12% = 60g

Total amount of color cream 120g

FIG.24

EXPERT COLORING 114.2

Take color cream

12/11 = 40g
12/01 = 40g
0/11 = 5g

Mixture: 1+2 with peroxide 9% = 160g

Total amount of color cream 245g

FIG.25

ROOT COLORING 115

First apply to areas with highest white content.

Apply color cream evenly!

FIG.26

ROOT COLORING 115.1

First apply to areas needing most lightening!

IMPORTANT: Apply greater amounts when coloring a lighter shade!

FIG.27

FULL COLORING 115.2

Apply color cream
only to length/ends
>2cm from root

FIG.28

FULL COLORING 115.3

Apply color cream
evenly from root to end.

FIG.29

ROOT COLORING 115.4

Apply color cream
to root only. Start
at backof head.

FIG.30

Action period 116

20 min without heat
10 min with heat

FIG.31

Action period 116.1

20 min without heat
10 min with heat

Additional action period
30 min without heat
15 min with heat

FIG.32

ROOT COLORING 117

After allowing cream to act on roots, moisten hair well, and emulsify color cream from the root along the length.

FIG.33

FULL COLORING 117.1

Work through hair repeatedly with a wide comb during action period.

FIG.34

FULL COLORING 117.2

Work through hair repeatedly with a wide comb during action period.

TIP: For more shine in length/end, make peroxide a degree stronger than at root.

FIG.35

118

After action period, emulsify
color with warm water and rinse well,
followed by light shampooing.
Neutralize and fix color
with hair grooming products.

DEVICE FOR DETERMINING METHOD DATA OF A METHOD FOR COSMETICALLY TREATING HAIR ON A PERSON'S HEAD

SUMMARY OF THE INVENTION

The invention is directed to a device for determining process data for a cosmetic process for treating hair on the head of a person.

The object of the invention is to provide a device for determining process data for a cosmetic process for treating hair on the head of a person which is particularly simple to handle, operate and apply.

This object is met according to the features of claim 1. Further advantageous developments of the invention are contained in the subclaims.

The invention is described more fully with reference to a number of drawings.

DESCRIPTION OF THE DRAWINGS

FIGS. 9 to 35 show different recipe and treatment instruction messages;

DETAILED DESCRIPTION OF THE INVENTION

Figure 1:
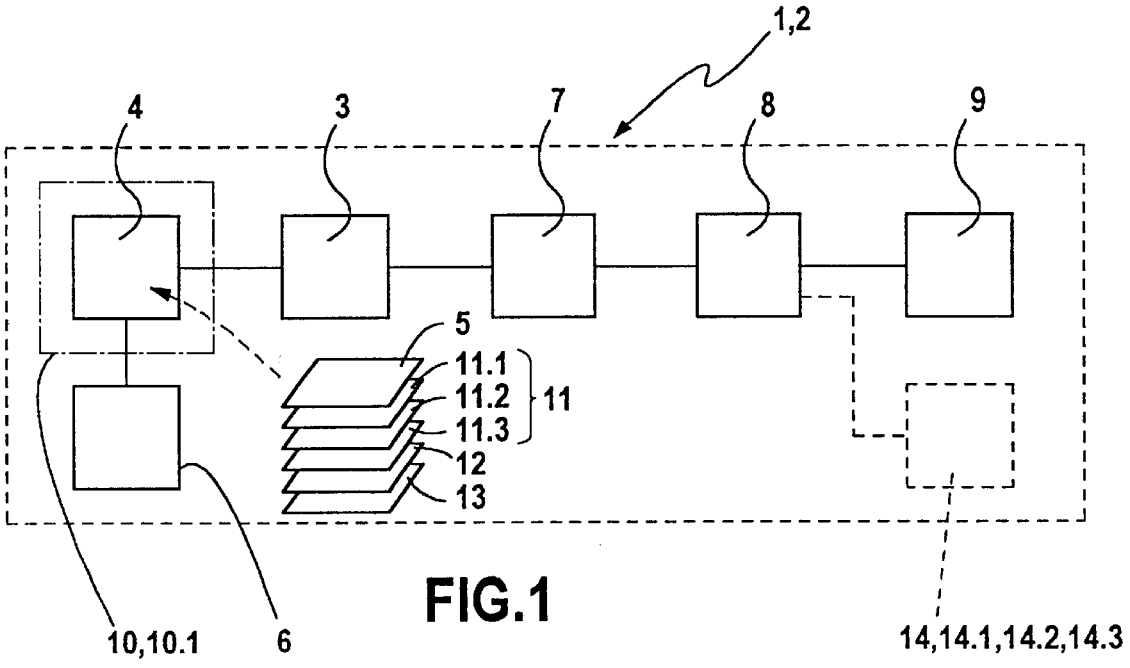
FIG. 1 shows a device in a block diagram.

FIG. 1 shows a device for determining process data for a cosmetic treatment process for treating hair on the head of a person, with a microprocessor 3, at least one storage 4 containing at least one application program 5, a data input device 6, a data evaluation device 7, at least one process data output device 8, and a display device 9, wherein the device 1 is provided as a battery-operated hand-held device 2, the storage or storages 4 being contained in at least one optionally exchangeable module 10; the application program 5 contains at least one data table 11 and application texts 12 which communicate with the data input device 6, the data evaluation device 7, the process data output device 8 and the display device 9. A dialog menu management is provided via the display device 9 as a data input device 6 by means of a menu program 13, wherein data is entered by means of a cursor function. The hand-held device 2 is optionally provided with at least one cable-connected and/or wireless interface 14, 14.1 for the process data output, for example, for printing out process data via a printer. A serial and/or infrared and/or radio interface 14.1 are/is provided as wireless interface 14.1.

Figure 2:
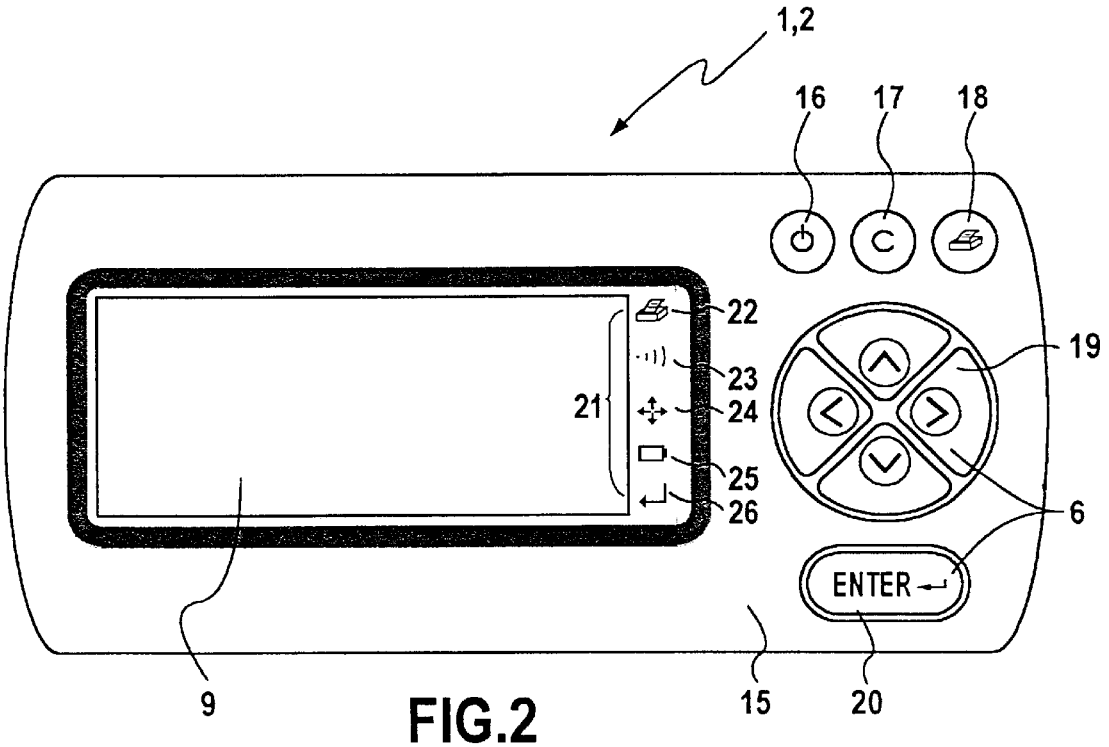
FIG. 2 is a top view showing the device as a hand-held device.

FIG. 2 shows a top view of the device 1 as a battery-operated hand-held device 2 having a plastic housing 15, a data input device 6 and a display device 9. Further, the hand-held device 2 is provided with an operating switch 16, a correction switch 17, a printout switch 18, a cursor switch 19 and an input switch 20 ("ENTER"). The display device 9 has a symbol panel 21 on one side, wherein symbols are displayed depending on the operating state. Accordingly, symbol 22 indicates a printout option, symbol 23 indicates a wireless process data output option, symbol 24 indicates different possible cursor directions by means of the cursor switch 19, symbol 25 indicates the battery capacity, and symbol 26 indicates an input option by means of the input switch 20.

Figure 3:
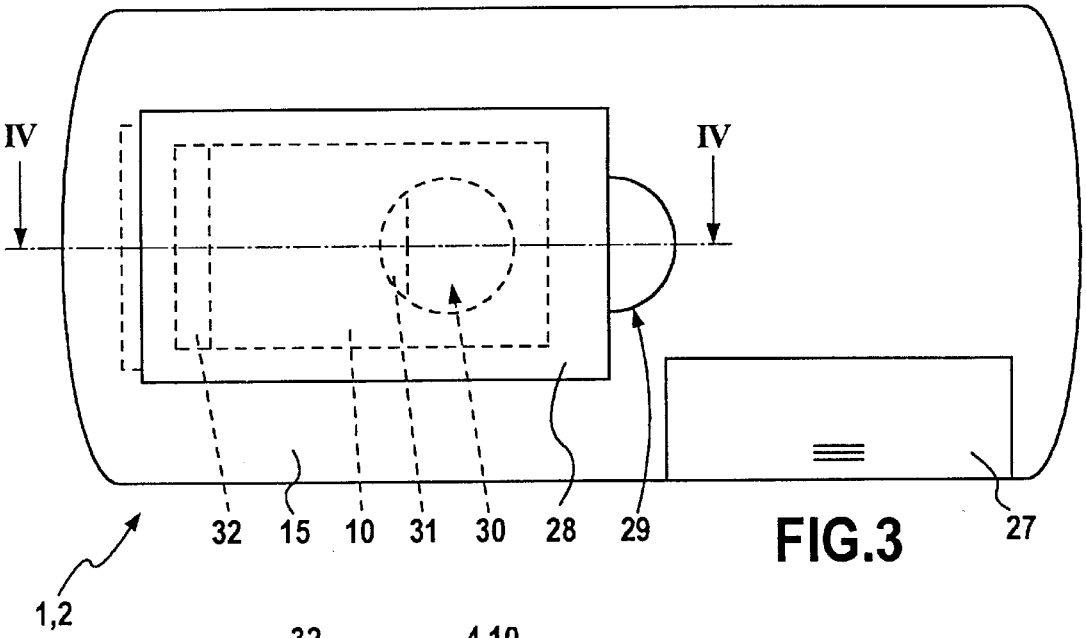
FIG. 3 shows a rear view of the hand-held device.
Figure 3A:
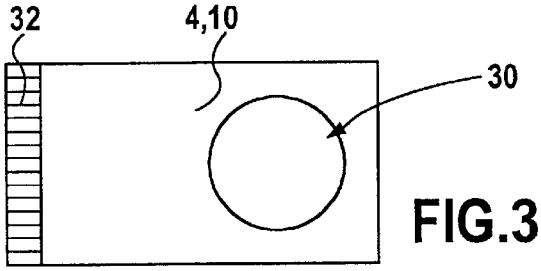
FIG. 3A shows a top view of a storage module.

FIG. 3 shows the back of the hand-held device 2, showing a battery cover 27 and a module cover 28. The housing 15 is provided with a recess 29 for manually opening the module cover 28 for purposes of inserting or removing or exchanging a module 10. For purposes of mechanical fastening, the module 10 is provided with a circular opening 30 which corresponds to a mating piece 31 on the module cover 28. The module 10 has an electric contact strip 32 by means of which an electrical and mechanical connection to the hand-held device 2 is carried out by means of a corresponding module connection part 33. For purposes of clarity, the module 10 is shown separately in a top view in FIG. 3A.

Figure 4:
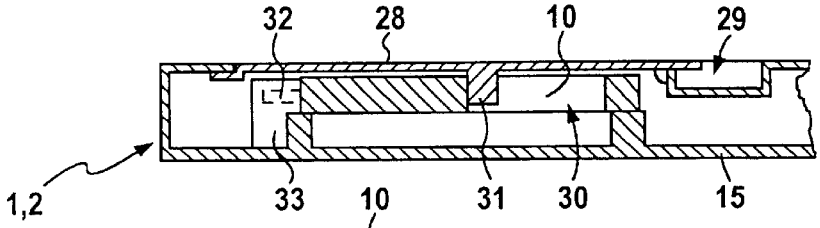
FIG. 4 is a sectional view according to section IV—IV of FIG. 3.

A section IV—IV according to FIG. 3 is shown in FIG. 4. In particular, the mechanical fastening of the module 10 by means of the mating piece 31 is shown.

Figure 4A:
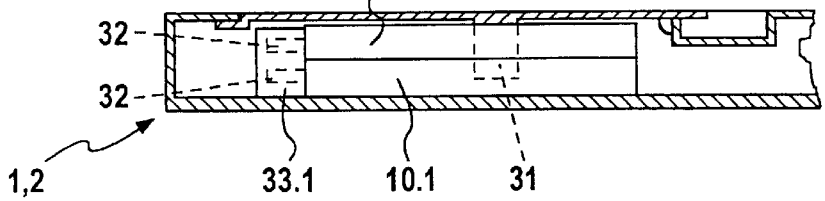
FIG. 4A is a sectional view corresponding to FIG. 4, but with two modules.

FIG. 4A shows a hand-held device 2 similar to FIG. 4, but with two modules 10, 10.1. Additional application programs (e.g., permanent wave process) can accordingly be used and can be correspondingly selected by the cursor switch 19 by means of a display (not shown) which is correspondingly arranged in front of the display 101 (FIG. 7).

Figure 5:
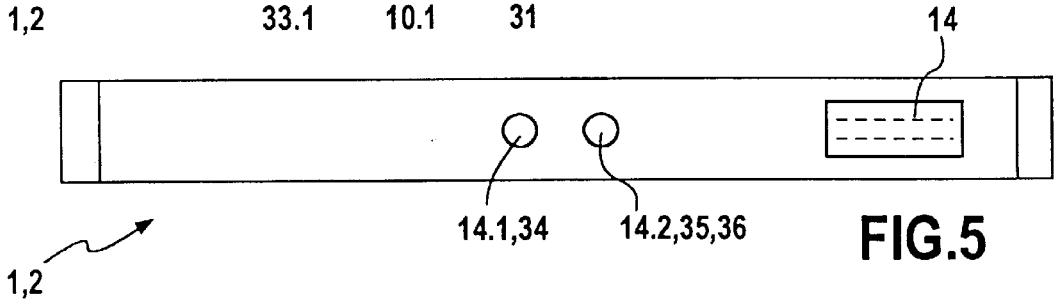
FIG. 5 shows a side view of the hand-held device.
Figure 6:
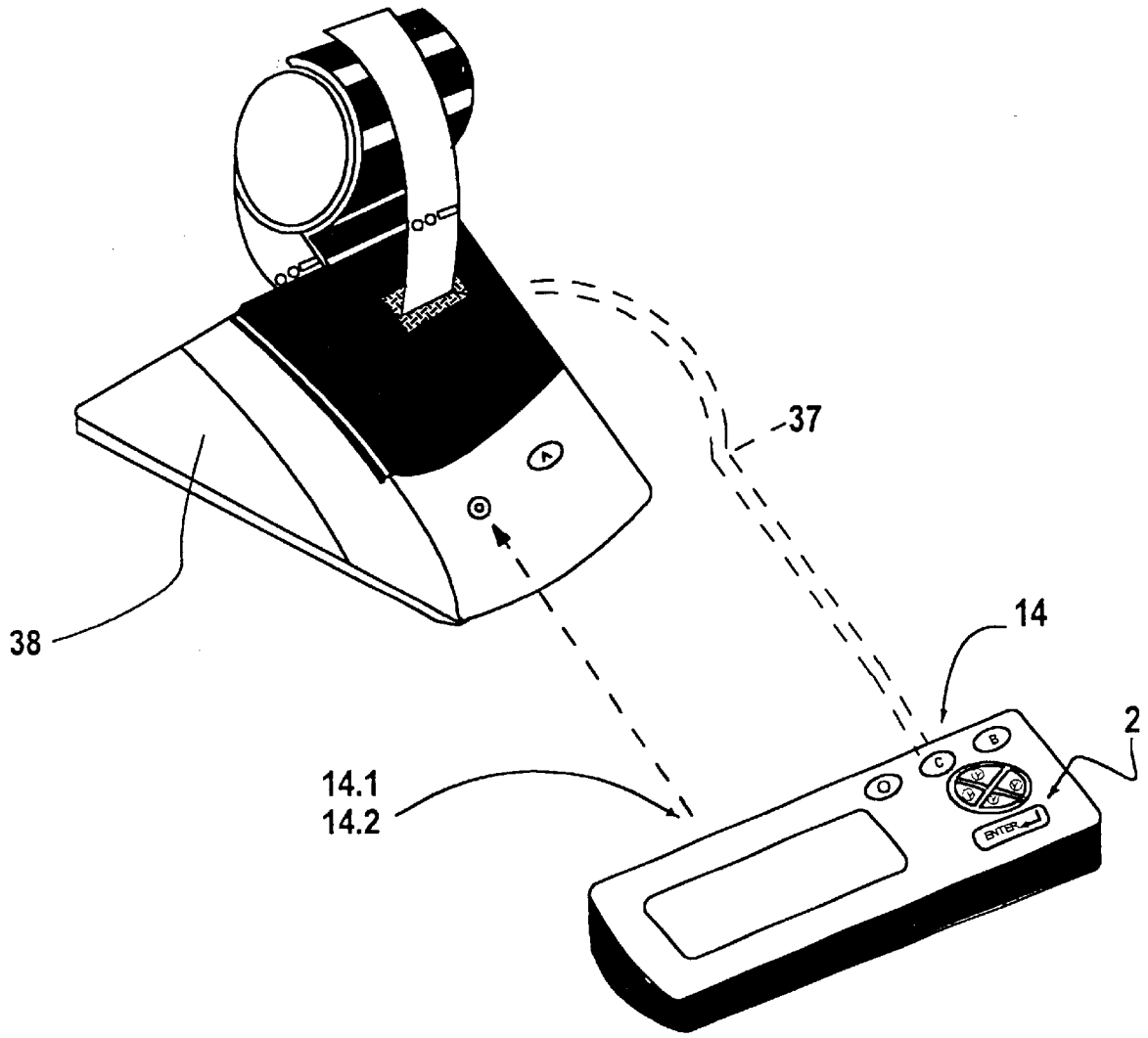
FIG. 6 shows a perspective view of the hand-held device with a printer.

A cable-connected (serial) interface 14 and a wireless (infrared or radio) interface 14.1 for process data output can be seen in FIG. 5. An infrared transmitting diode 34 and an infrared receiving diode 35 or also an appropriately combined diode 36 can be provided, for example, as a bidirectional infrared interface 14.2. A printer, e.g., a label printer 38, can be connected via a corresponding cable 37 to the serial interface 14. However, another device such as a hair treatment device (not shown) or a scale 60 (FIG. 36) may also be selectively connected via the interface 14, 14.1, 14.2. In particular, a wireless, bidirectional interface 14.2 offers a variety of application possibilities by means of data transfer given an appropriate construction of the devices (e.g., scale 60), e.g., a data reception confirmation at the hand-held device 2 as well as at another device (FIG. 6), as selected.

Figure 7:
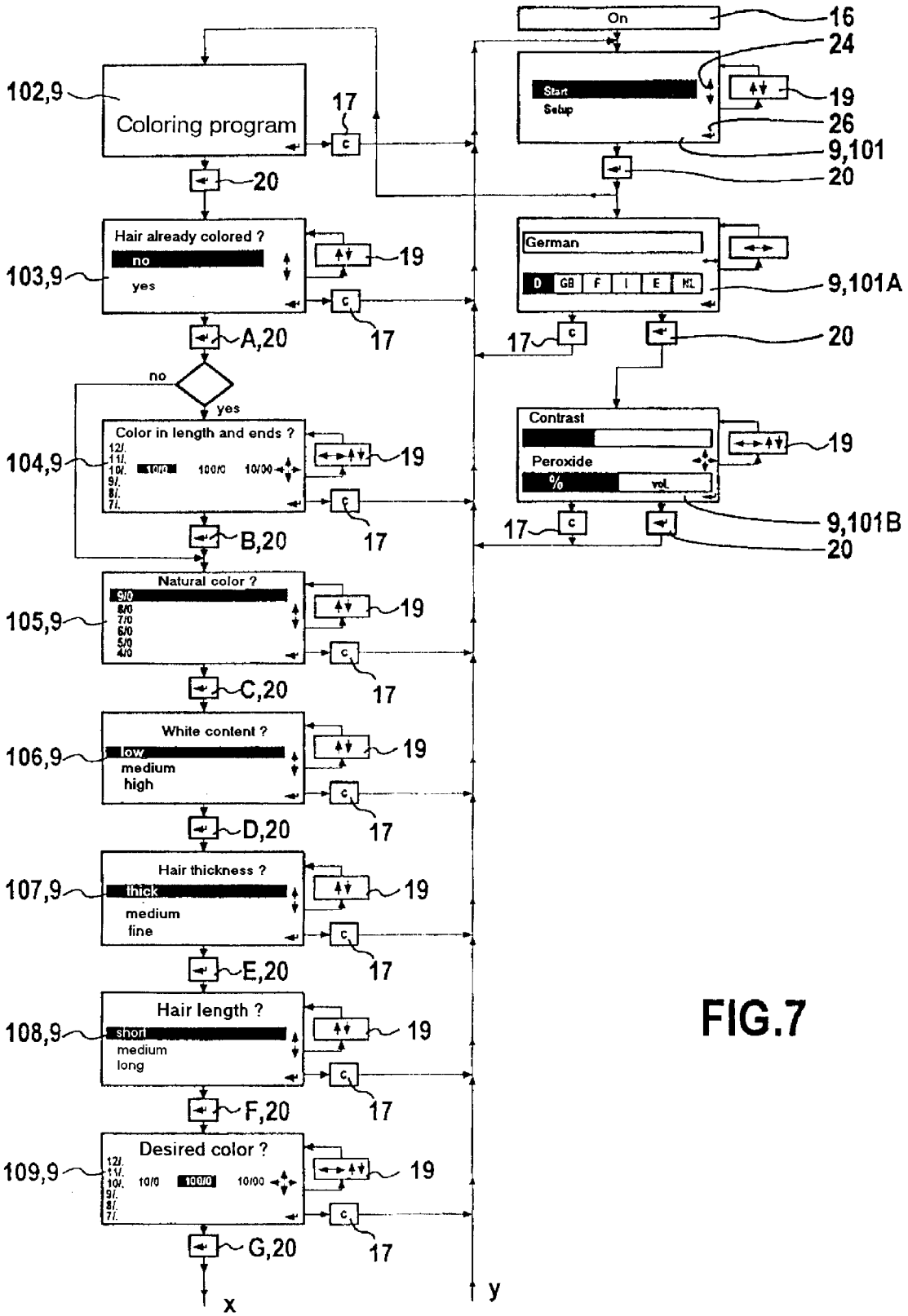
FIGS. 7 and 8 show a structural plan.
Figure 8:
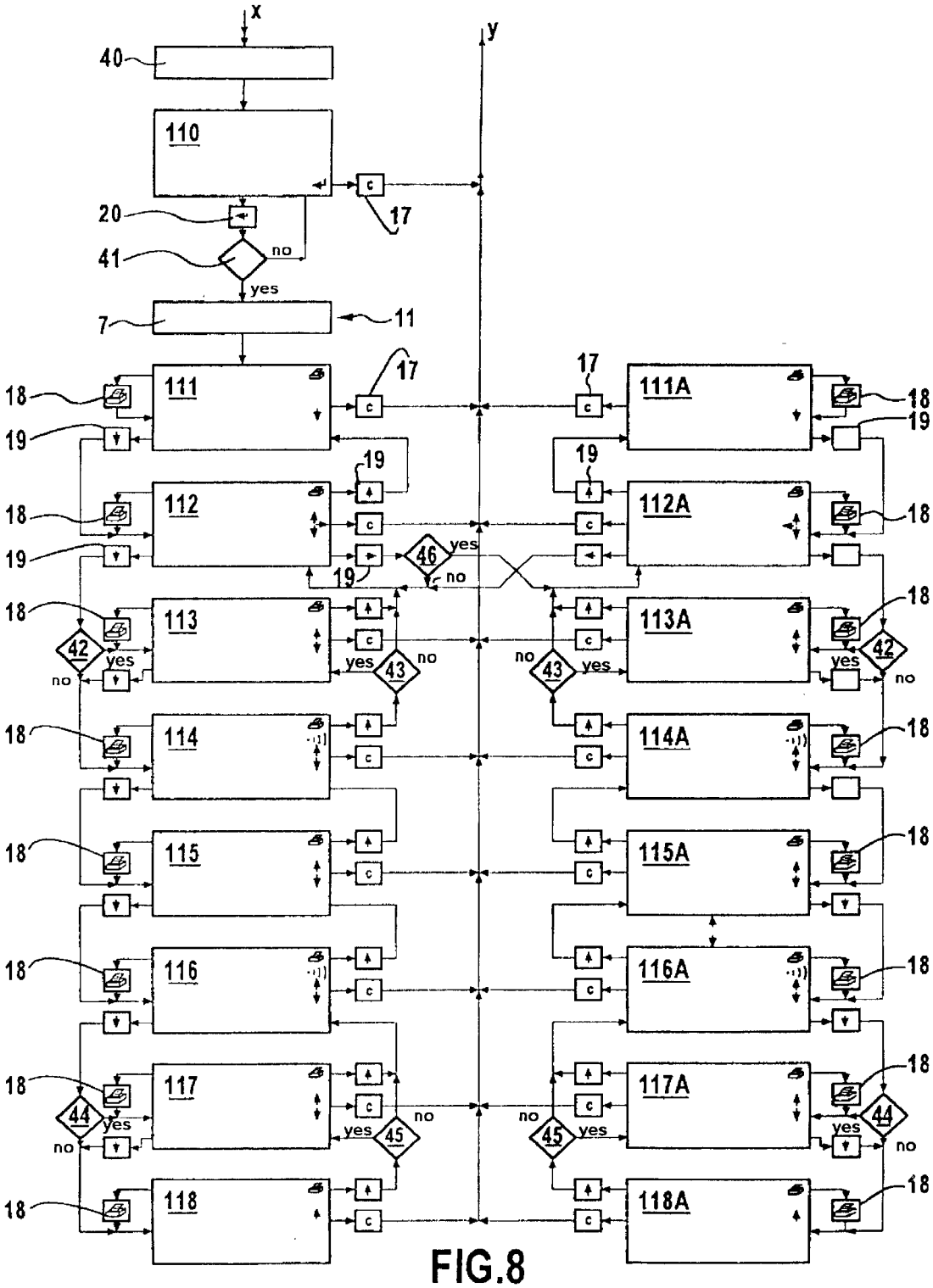

An application program 5 in the form of a structure plan is illustrated in more detail in the pertinent FIGS. 7 and 8 (X with X and Y with Y) using the example of hair coloring. Corresponding application programs, for example, for hair grooming or a permanent wave treatment, are analogous. First, the hand-held device 2 is switched on via the operating switch 16. A message 101, "start/setup", is displayed on the display 9 and the symbol for the cursor direction 24 indicating possible cursor directions as well as the symbol for possible input 26 are shown on the symbol panel. In this case, the cursor switch 19 can be used to choose between "start" and "setup". To start, the cursor (shown as a black bar) is set to "start" and input is carried out with the input switch 20 (enter). A message 102 indicating a (selected) user program, in this case, "coloring program", then appears on the display 9. The correction switch 17 can then be used to return to the start position. Pressing the input switch 20 displays a message 103 with the question "Hair already colored?" (parameter A) and the possible responses "no/yes". If the response is "no", the cursor is set to "no" and the input switch 17 is pressed, whereupon a message 105 with the question "Natural hair color?" (parameter C) appears with a list of natural hair colors (e.g., 9/0, 8/0, 7/0, etc.) which can be selected with the cursor (as described above). In case the hair is already colored, a message 104 appears with the question "Color length to ends?" (parameter B) along with a list of colors which can be selected with the cursor. This is followed correspondingly by message 106 with the question "White content?" (parameter D) with a selection "low/medium/high", message 107 with the question "Hair thickness?" (parameter E) with a choice of "thick/medium/fine", message 108 with the question "Hair length?" (parameter F) with a choice of "short/medium/long", and message 109 with the question "Desired color?" (parameter G) with a list of selectable colors, for example, color numbers 100/0. Then, in block 40, the appropriate recipe number is determined from a stored list of recipe numbers, followed by a message 110, e.g., "Thanks for your input! We will recommend a recipe for you". If no recipe number is found (error) by corresponding parameters in block 41 (Does recipe number exist?), this will be displayed in a corresponding manner. Process data from at least one data table 11, e.g., from a combined color table 11.1, recipe number table 11.2 and recipe table 11.3 (FIG. 1), are then determined in the data evaluation device 7 (FIG. 8). Then, a review of the entered data (FIG. 9) first appears on the display 111 (using the example of root coloring):

"ANALYSIS—RESULTS
Root coloring
length/ends: 12/0
natural hair color: 6/0
white content: low
hair thickness: thick
hair length: medium
desired color: 12/00."

This message 111 (and any others) can be printed out by the printout switch 18. In the case of full coloring, a message 111.1 is displayed (FIG. 10). The next message 112, the appropriate recipe for standard coloring (FIG. 11) is displayed by means of the cursor switch 19 (down arrow designates scroll down) and can be printed out by the printer 38 (FIG. 6) via the printout switch 18:

"STANDARD COLORING
tint: 12/03
peroxide: 12%
mixture: 1+2
amount coloring cream: 120 gr
total action time: 60 min".

Mixture "1+2+" means 1 part coloring substance 12/03 and 2 parts peroxide. Another five message possibilities 112.1 to 112.5 are shown in FIGS. 12 to 16 with the parameters of pre-bleaching and two or three different color tints.

FIGS. 17 to 21 show different messages 113, 113.1 to 113.4 for the first work step of a pretreatment, which can also be dispensed with depending on the coloring task. Depending on the recipe, a message 113/FIG. 17 (or a message 113.1 to 113.4/FIGS. 18 to 21) appears with information about a pretreatment (which is decided in area 42; one of messages 114 to 114.2 appears in the absence of a pretreatment work step):

"Full pre-bleach with bleaching agent to the desired degree of lightness BLEACH: PEROXIDE 6%."

Depending on the recipe, however, one of messages 113.1 to 113.4 can also appear with information about pretreatment corresponding to FIGS. 18 to 21 (FIG. 18, message 113.1: root pre-bleaching; FIG. 19, message 113.2:. Bleaching wash; FIG. 20, message 113.3: bleaching wash length and ends; FIG. 21, message 113.4: bleaching wash root).

Depending on the recipe, the second work step is information about color mixing, amount of dye and peroxide via one of messages 114 (standard coloring), FIG. 22 (1 color tint); 114.1 (standard coloring), FIG. 23 (2 color tints); 114A (expert coloring), FIG. 24 (3 color tints). Message 113 . . . can be displayed by pressing once on the cursor switch 19 or message 112 . . . can be displayed by pressing again on the cursor switch 19.

The next display 115, FIG. 25; or 115.1, FIG. 26; or 115.2, FIG. 27; or 115.3, FIG. 28; or 115.4, FIG. 29 gives directions for applying the prepared color cream in a third work step.

Depending on the recipe, another (standard) message 116, FIG. 30; or 116.1, FIG. 31 is displayed which gives directions for a fourth work step for a corresponding action time with or without supply of heat, this supply of heat being effected by a corresponding (heat) treatment device.

A message 117, FIG. 32; or 117.1, FIG. 33; or 117.2, FIG. 34, may possibly be displayed via area 44 which gives directions for the treatment of the lengths and ends.

Finally, information about an after-treatment is given by a message 118, FIG. 35. By pressing once on the cursor switch 19 (up arrow), message 117 can be displayed, as the case may be, via panel 45 or, by pressing again, the message 116/ 115/ 114/ 113/ 112/ 111 can be displayed again. Conversely, the messages 111 to 118 can be scrolled from top to bottom by pressing on the cursor switch 19 (down arrow).

In the case of message 112 (FIG. 8), a standard coloring can be switched to expert coloring by the cursor switch 19 (right arrow) via block 46, wherein the expert coloring message 112A of the expanded recipe and the expert coloring message 114A of the composition differ from the messages for standard coloring 112–112.5 and 114–114.2.

As can be seen from message 101 (FIG. 7), a desired application text can be displayed in different languages (e.g., D for German, GB for English, F for French, I for Italian, E for Spanish, NL for Dutch) via the "setup" setting with the cursor switch 19 after message 101A. The contrast and peroxide in percent (%) or volume (vol.) can be chosen with message 101B via the cursor switch 19.

Figure 36:
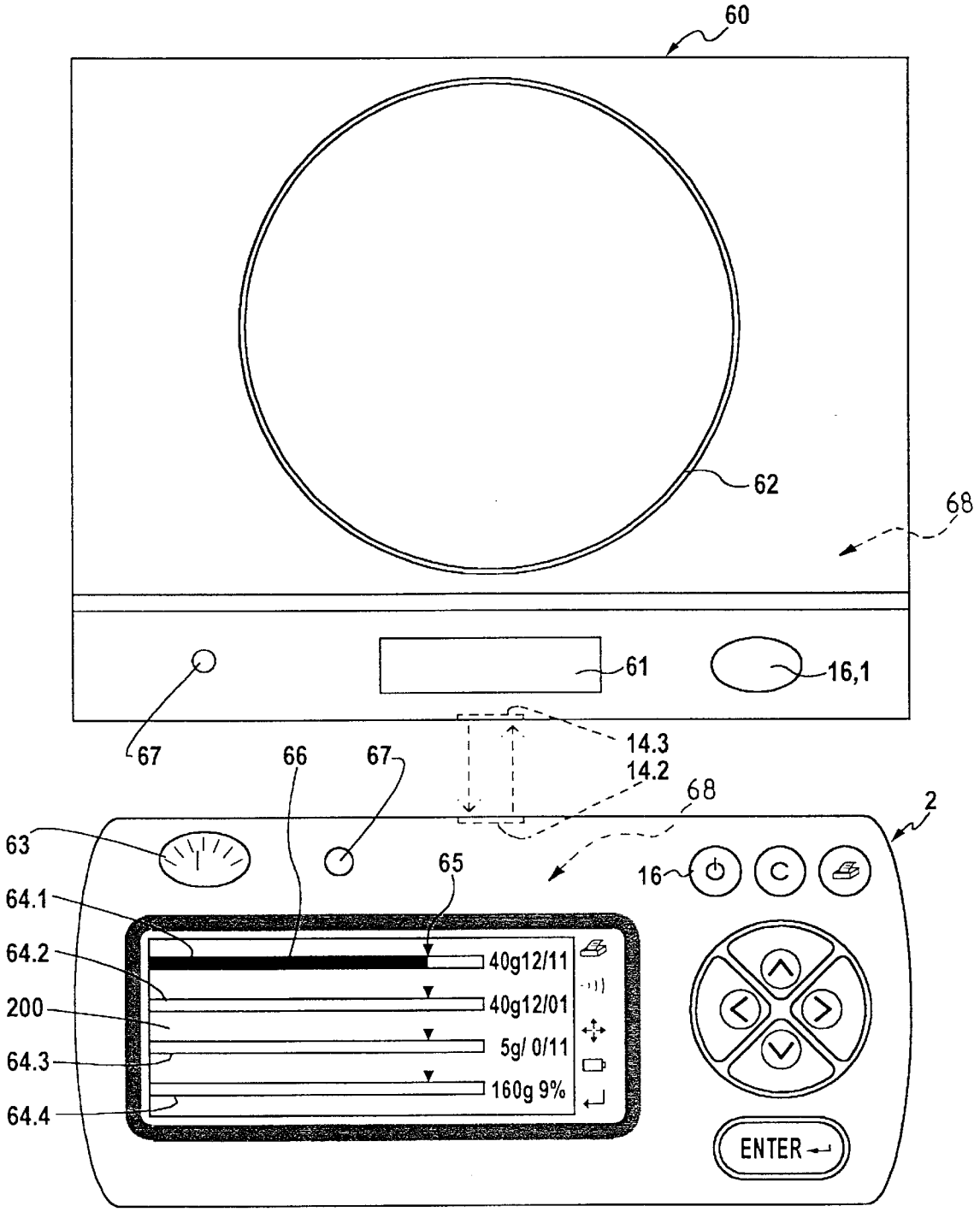
FIG. 36 is a top view showing the hand-held device with a scale.

FIG. 36 shows a scale 60 which is provided with a weight indicator 61, a scale pan 62, an operating switch 16.1 and a wireless bidirectional interface 14.3. The hand-held device 2 with its wireless bidirectional interface 14.3 is constructed in such a way that it can communicate bidirectionally with the scale 60 via the interface 14.3, namely, in such a way that the amount indications in the recipe, e.g., according to message 114A (FIG. 24), are transmitted to the scale 60 via the interfaces 14.2, 14.3, which is triggered by pressing on a measurement switch 63. A message 200 appears now with a measurement indicator 64.1 with a mark 65 and a color quantity/tint "40 g 12/11". This value of 40 g is achieved when the black bar 66 has reached the mark 65. The measurement switch 63 is then pressed again, so that a measurement indicator 64.2 with the mark 65 and a color quantity indication/tint "40 g 12/01" appears. This value of 40 g is achieved when the black bar 66 has reached the mark 65. The measurement switch 63 is then pressed again and a measurement indicator 64.3 with the mark 65 and a color quantity indication/tint "5 g 0/11" appears. This value of 5 g is achieved when the black bar 66 has reached the mark 65.

The measurement switch 63 is then pressed again, so that a measurement indicator 64.4 with mark 65 and a peroxide quantity indication "160 g 9%" appears. This value of 160 g is achieved when the black bar 66 has reached the mark 65. Message 200 is extinguished by pressing again on the measurement switch 63, so that the weighing process is concluded. The components located in the scale pan 62 are now mixed and available for use (hair coloring) as a color cream. The measurement indicators 64.1 to 64.4 can be displayed simultaneously—as is shown in FIG. 36—or only the current one can be shown. The weight can be read off in grams in addition via the weight display 61 of the scale 60 and, in addition, via the message 200, as desired. However, the weight indications on message 200 could also be dispensed with, since the required weight is attained when the black mark 66 is reached. With the scale 60, the weight display 61 could be dispensed with, since the corresponding weight indications are shown in display 200 of the hand-held device 2; but then the scale 60 would no longer be usable for general purposes, rather only specifically with the hand-held device 2. The scale 60 can be provided with a correcting device 68 as a further user convenience in order to be able to compensate for mass deviations (overdosage) of the recipe proportions in the given mixing ratio or to be able to provide mass deviations deliberately, e.g., within the framework of an individual expert recipe.

To store and call up person-specific process data, a central computer, not shown, can be provided, so as to create a kind of electronic customer card file.

Figure 37:
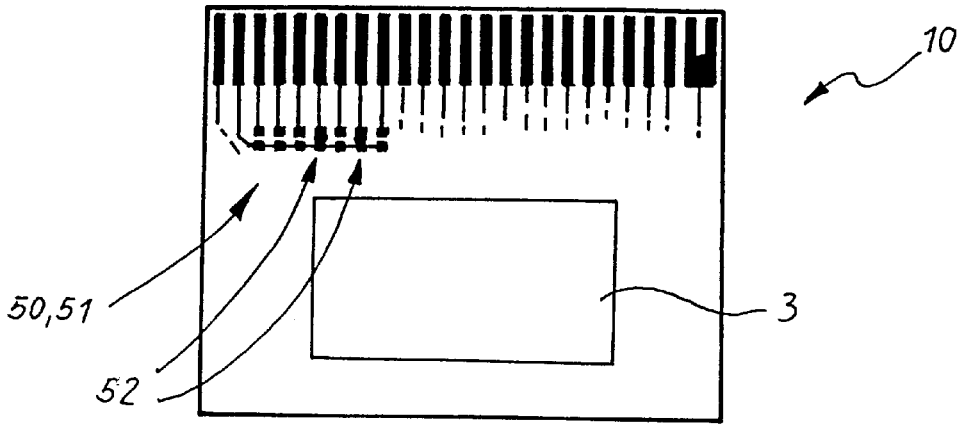
FIG. 37 shows a module with a country code.
Figure 38:
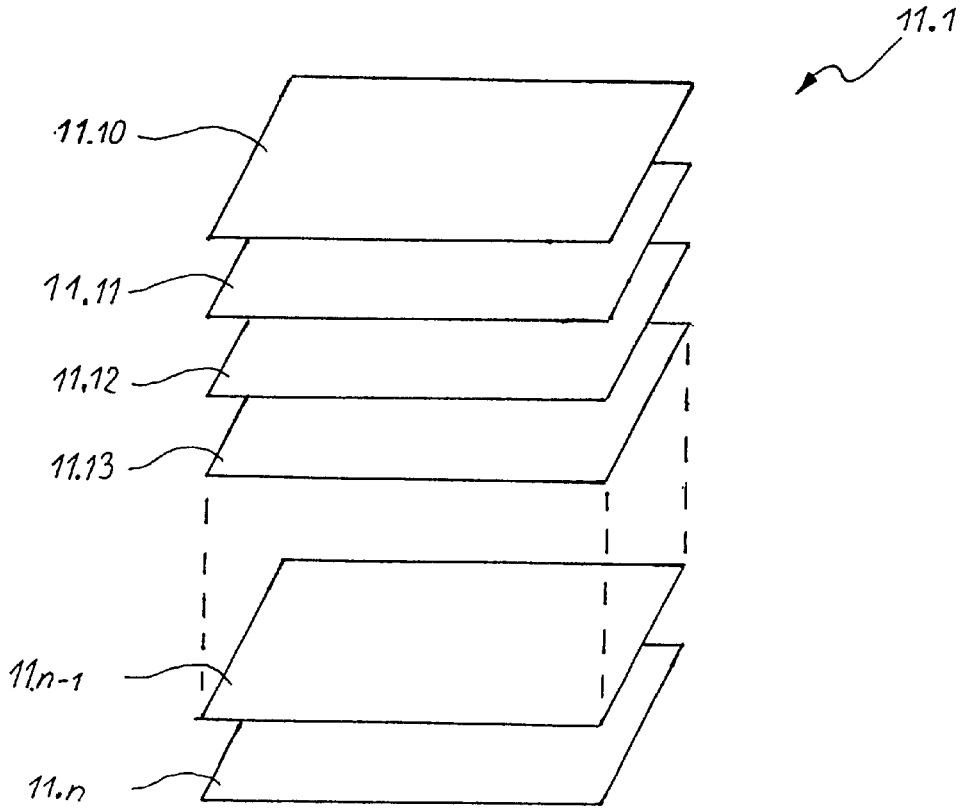
FIG. 38 shows country-specific color product range lists.

FIG. 37 shows a circuit board of the module 10 with the microprocessor 3 and a binary switch 51 for a country-specific color product range list 11.10–11.n (FIG. 38). The binary switch 51 constructed as a printed circuit is programmed in binary by corresponding solder bridges 52 and accordingly forms a country code 50 which corresponds to a determined color product range list 11.10–11.n. In practice, there are approximately 80 to 120 different color products of approximately 155 possible color products of an entire range per country range which are listed systematically and in tabular form in a color product range list 11.10–11.n. A desired application text can be set independently from this.

Reference Numbers

1 device
2 hand-held device
3 microprocessor
4 storage
5 application program
6 data input device
7 data evaluation device
8 process data output device
9 display device (display)
10 module
11 data table
11.1 color table
11.2 recipe number table
11.3 recipe table
11.10–11.n color product list
12 application texts
13 menu program
14 cable-connected interface
14.1 wireless interface
14.2,14.3 bidirectional interface
15 plastic housing
16,16.1 operating switch
17 correction switch
18 printout switch
19 cursor switch
20 input switch
21 symbol panel
22 printout option symbol
23 transmit symbol
24 cursor direction symbol
25 battery capacity symbol
26 input option symbol
27 battery cover
28 module cover
29 recess
30 opening
31 mating piece
32 contact strip
33 module connection part
34 IR transmitting diode
35 IR receiving diode
36 transmitting/receiving diode
37 cable
38 printer
40 block: determine recipe number
41 area: Does recipe number exist?
42 area: Pretreatment?
43 area: Message 113?. . .
44 area: Directions?
45 area: Message 117?. . .
46 area: Expert recipe?
50 country code
51 binary switch
52 solder bridge
60 scale
61 weight indicator
62 scale pan
63 measurement switch
64.1–64.4 measurement indicator
65 mark
66 bar
67 acoustic and/or optical signal
68 correcting device
100–118 message
200 recipe message in grams

What is claimed is:

1. A device (1) for determining process data for a cosmetic treatments process for treating hair on a head of a person, the device comprising:

a. a microprocessor (3);

b. at least one storage (4) containing at least one application program (5);

c. a data input device (6);

d. a data evaluation device (7);

e. at least one process data output device (8); and f. a display device (9);

wherein the device (1) is provided as a battery-operated hand held device (2); wherein the storage or storages (4) are contained in at least one optionally exchangeable module (10, 10.1); wherein the application program (5) contains at least one data table (11) and application texts (12) which communicate with the data input device (6), the data evaluation device (7), the process data output device (8) and the display device (9); wherein a dialog menu management means is provided via the display device (9) as a data input device (6) by means of a menu program (13); and wherein data is entered by means of a cursor function.

2. The device according to claim 1, characterized in that the application program (5) is provided for a hair coloring and/or hair grooming and/or for a permanent wave treatment.

3. The device according to claim 1, characterized in that an application text (50) can be selected optionally from a plurality of languages.

4. The device according to claim 1, characterized in that the following parameters are provided as data input for a hair coloring:

a. Hair already colored?;

b. Color length and ends?;

c. Natural hair color?;

d. White content?;

e. Hair thickness?;

f. Hair length?; and g. Desired color?

5. The device according to claim 1, characterized in that the determined process data consists of a recipe with an optional corresponding action time.

6. The device according to claim 5, characterized in that a recipe message (112) is optionally provided for a standard or expert coloring.

7. The device according to claim 5, characterized in that stepwise operating instruction messages (113–118) are provided according to the recipe message (112).

8. The device according to claim 1, characterized in that a central computer is provided for storing and calling up person-specific process data.

9. The device according to claim 1, characterized in that color table (11.1) is divided into country-specific color product lists (11.10–11.n) each having a corresponding country code (50).

10. The device according to claim 9, characterized in that a binary switch (51) for the country code (50) is provided in the module (10).

11. The device according to claim 1, characterized in that the hand-held device (2) has at least one cable-connected and/or wireless interface (14, 14.1, 14.2, 14.3) for the process data output.

12. The device according to claim 11, characterized in that the interface (14, 14.1, 14.2) communicates with a printer (38).

13. The device according to claim 12, characterized in that a label printer (38) is provided.

14. The device according to claim 11, characterized in that the interface (14, 14.1, 14.2) communicates with a device for treating hair on the head of a person.

15. The device according to claim 11, characterized in that a bidirectional interface (14.2, 14.3) for a data transfer is provided.

16. The device according to claim 15, characterized in that the bidirectional interface (14.2, 14.3) with a wireless transmitter/receiver (34, 35; 36) is provided.

17. The device according to claim 16, characterized in that an infrared transmitter/receiver (34, 35; 36) is provided.

18. The device according to claim 1, characterized in that a serial and/or infrared interface and/or radio interface (14, 14.1, 14.2, 14.3) is provided.

19. The device according to claim 1, characterized in that the hand-held device (2) and an electronic scale (60) communicate in dialog with one another via the interfaces (14.2, 14.3).

20. The device according to claim 19, characterized in that the scale (60) has a weight indicator (61).

21. The device according to claim 20, characterized in that the display device (9) of the hand-held device (2) is provided as a weight indicator for the scale (60).

22. The device according to claim 20, characterized in that the weight indicator (61) displays the measurement values of the scale (60) digitally and/or in analog.

23. The device according to claim 19, characterized in that an acoustic and/or an optical signal (67) is triggered when a given measurement value of the scale (60) is reached.

24. The device according to claim 19, characterized in that the scale (60) or the hand-held device (2) is provided with a correcting device (68) for individual recipe proportions.

* * * * *